US011421529B2

(12) United States Patent
Magalhaes et al.

(10) Patent No.: US 11,421,529 B2
(45) Date of Patent: Aug. 23, 2022

(54) ACTIVATION AND CONTROL OF DOWNHOLE TOOLS INCLUDING A NON-ROTATING POWER SECTION OPTION

(71) Applicant: Halliburton Energy Services, Inc., Houston, TX (US)

(72) Inventors: Thiago S. Magalhaes, Kingwood, TX (US); Kennedy J. Kirkhope, Leduc (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/954,262

(22) PCT Filed: Jan. 8, 2018

(86) PCT No.: PCT/US2018/012832
§ 371 (c)(1),
(2) Date: Jun. 16, 2020

(87) PCT Pub. No.: WO2019/135775
PCT Pub. Date: Jul. 11, 2019

(65) Prior Publication Data

US 2021/0087929 A1 Mar. 25, 2021

(51) Int. Cl.
*E21B 49/08* (2006.01)
*E21B 7/06* (2006.01)
(Continued)

(52) U.S. Cl.
CPC ..... *E21B 49/088* (2013.01); *E21B 7/068* (2013.01); *E21B 17/18* (2013.01); *E21B 21/103* (2013.01); *E21B 21/12* (2013.01); *E21B 23/006* (2013.01); *E21B 44/005* (2013.01)

(58) Field of Classification Search
CPC ..... E21B 49/088; E21B 21/12; E21B 21/103; E21B 17/18; E21B 7/068; E21B 23/006; E21B 44/005; E21B 49/08
See application file for complete search history.

(56) References Cited

U.S. PATENT DOCUMENTS 5,311,952 A * 5/1994 Eddison ..... E21B 7/067 175/107
5,535,835 A * 7/1996 Walker ..... E21B 7/067 175/73

(Continued)

FOREIGN PATENT DOCUMENTS

WO WO 2015/061047 A1 4/2015

OTHER PUBLICATIONS

OilGasGlossary.Com, https://web.archive.org/web/20160309020907/http://oilgasglossary.com/annulus.html, Mar. 9, 2016, pp. 1-2. (Year: 2016).*

(Continued)

*Primary Examiner* — Jonathan Malikasim
(74) *Attorney, Agent, or Firm* — Haynes and Boone, LLP

(57) ABSTRACT

A system and method to control fluid flow to downhole tools and equipment, and to allow formation testing and sampling operations is disclosed. The system includes an actuator assembly that may be mechanically or electrically activated to operate a flow diverter assembly. The flow diverter assembly may divert fluid flow to the annulus of the wellbore, to the stator of a power section, through a by-pass bore in a rotor of the power section, or any combination thereof. In the mechanically actuated actuator assembly, the actuator assembly is activated by pressure changes in the fluid introduced by cycling the pumps at the surface; and in the (Continued)

electrically actuated actuator assembly, the actuator assembly is activated by downlinks sent from a surface control unit or computer at the surface.

17 Claims, 12 Drawing Sheets

(51) Int. Cl.

| | |
|---|---|
| ***E21B 23/00*** | (2006.01) |
| ***E21B 21/12*** | (2006.01) |
| ***E21B 21/10*** | (2006.01) |
| ***E21B 17/18*** | (2006.01) |
| ***E21B 44/00*** | (2006.01) |

(56) References Cited

U.S. PATENT DOCUMENTS

| | | | | |
|---|---|---|---|---|
| 8,307,902 | B2 * | 11/2012 | Telfer | E21B 34/14 166/334.4 |
| 8,381,839 | B2 * | 2/2013 | Rosenhauch | E21B 4/02 175/107 |
| 8,919,460 | B2 * | 12/2014 | Joulin | E21B 4/02 175/78 |
| 9,404,326 | B2 * | 8/2016 | Zhou | E21B 21/08 |
| 2010/0314174 | A1 * | 12/2010 | Denoix | E21B 7/068 175/57 |
| 2011/0162890 | A1 | 7/2011 | Radovan | |
| 2011/0174543 | A1 * | 7/2011 | Walkingshaw | E21B 49/06 175/58 |
| 2012/0018172 | A1 | 1/2012 | Javed | |
| 2014/0102800 | A1 | 4/2014 | Lacour | |
| 2016/0168913 | A1 | 6/2016 | Hay | |

OTHER PUBLICATIONS

International Search Report and The Written Opinion of the International Search Authority, or the Declaration, dated Oct. 17, 2018, PCT/US2018/012832, 13 pages, ISA/KR.

* cited by examiner

ACTIVATION AND CONTROL OF DOWNHOLE TOOLS INCLUDING A NON-ROTATING POWER SECTION OPTION

CROSS REFERENCE TO RELATED APPLICATIONS

The present application is a U.S. National Stage patent application of International Patent Application No. PCT/US2018/012832, filed on Jan. 8, 2018, the benefit of which is claimed and the disclosure of which is incorporated herein by reference in its entirety.

TECHNICAL FIELD

The present disclosure generally relates to oilfield equipment and, in particular, to downhole tools, drilling and related systems and techniques for drilling, sampling, completing, servicing, and evaluating wellbores in the earth. More particularly still, the present disclosure relates to systems and methods for controlling fluid flow to downhole tools and equipment.

BACKGROUND

Wellbores are often drilled through a geologic formation for hydrocarbon exploration and recovery operations. Drilling and production operations involve a great quantity of information and measurements relating to parameters and conditions downhole. Such information typically includes characteristics of the earth formations traversed by the wellbore in addition to data relating to the size and configuration of the borehole itself. Often, measurements are made while the wellbores are being drilled. Systems for making these measurements during a drilling operation can be described broadly as formation testing and sampling tools and can include both logging-while-drilling (LWD) systems and measurement-while-drilling (MWD) systems. Such system are may be integrated into a bottom hole assembly (BHA) of a drill string.

For some time, circulation subs have been deployed in drill stings to redirect drilling fluid normally pumped through the BHA. For example, it may be undesirable to pump certain heavy drilling fluids utilized in wellbore pressure control through the BHA where such heavy drilling fluids could damage the LWD/MWD equipment. Rather, circulation subs may port such heavy drilling fluids directly to the wellbore annulus, thus bypassing the BHA. Such circulation subs are commonly activated by dropping or pumping a ball down to the circulation sub. It will be appreciated that certain equipment in the tool string, such as mud motors of a power section or LWD/MWD equipment may have diameter changes and restrictions that would not be conducive to having a ball pass there through and therefore, circulation subs activated by balls must be deployed in the drill string above such BHA equipment. Moreover, such circulation subs are typically limited to either a first flow path that directs drilling fluids into the wellbore annulus or a second flow path that simply passes drilling fluids through the circulation sub down to the BHA.

One use of drilling fluid pumped down through the circulation sub to the BHA is to drive the power section. Specifically, the drilling fluid passes between the rotor and stator of a mud motor of a power section in order to activate the rotor and generate power. However, because operation of mud motors of power sections can cause intrinsic vibration that could interfere with operation of LWD/MWD equipment, power sections and LWD/MWD equipment are not typically deployed together. Rather, drill string systems that employ LWD/MWD equipment typically rely upon a rotary steerable system (RSS) to replace conventional directional tools such as mud motors. Thus, the benefits and usefulness of having a mud motor present may be sacrificed in drill string systems where LWD/MWD equipment is utilized.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements. Embodiments are described in detail hereinafter with reference to the accompanying figures, in which.

DETAILED DESCRIPTION OF THE DISCLOSURE

Generally, a flow control device is provided for altering fluid flow to BHA tools during various operations such as drilling and sampling. The flow control device includes an actuator assembly for driving a flow diverter assembly between various configurations that divert fluid flow along different flow paths. First and second flow paths are generally defined within an internal flow annulus, with one flow path passing through the central bore of the BHA tool and another passing around the central bore. A third flow path extends to the exterior of the BHA tool. In one embodiment, the flow control assembly is a pressure activated, spring loaded, rotatable cam barrel having an indexing groove formed in the exterior surface of a sleeve. Cycling of drilling fluid between different pressures results in relative movement between the barrel and a follower engaging the indexing groove of the cam, which drives the flow diverter between the various configurations. In other embodiments, the actuator assembly is electronically driven and may be sonde-based, insert-based, or outsert-based.

Figure 1:
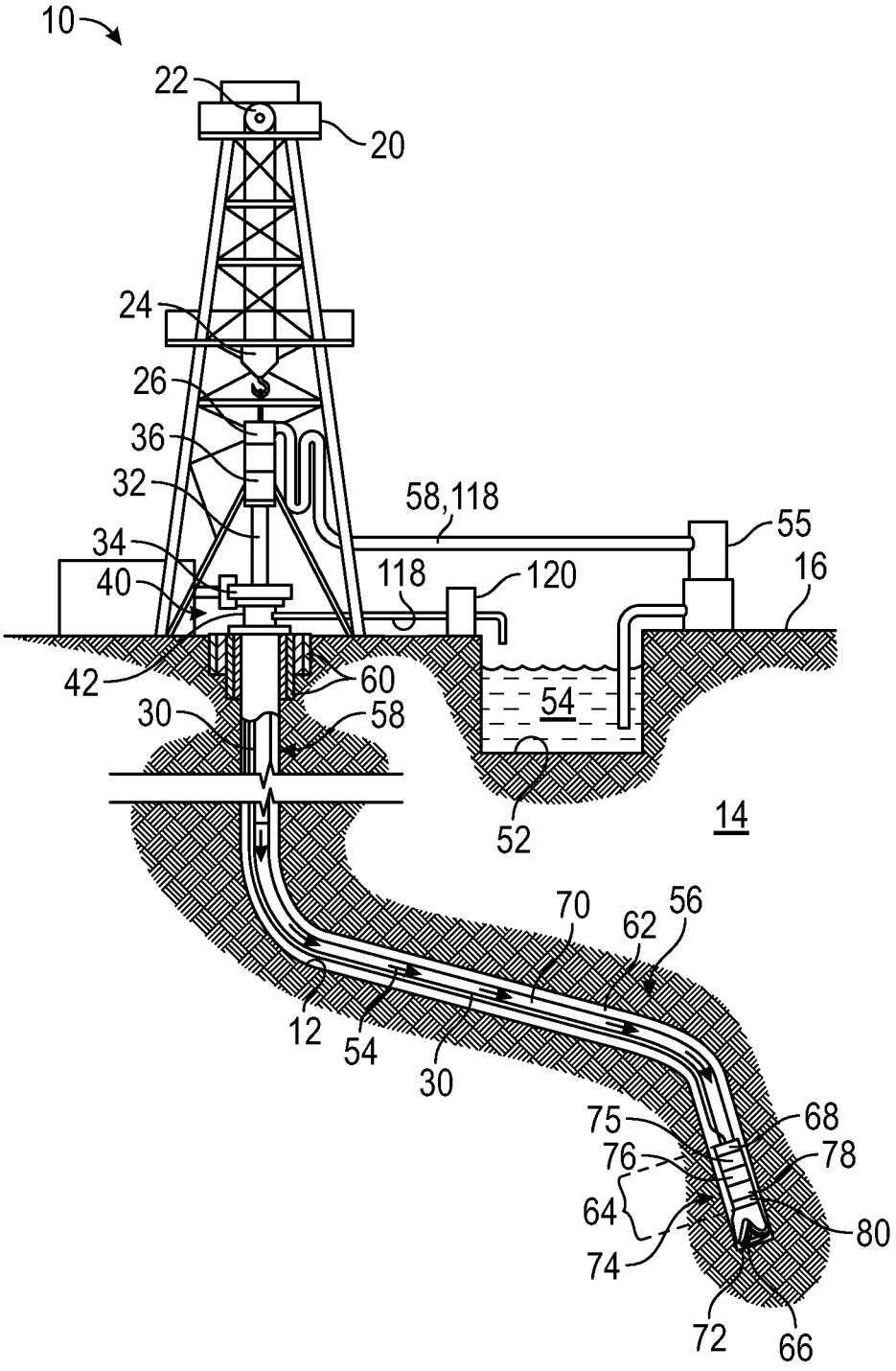
FIG. 1 is an elevation view in partial cross section of a land-based well system with a flow control device for controlling downhole tools and equipment according to an embodiment.
Figure 2:
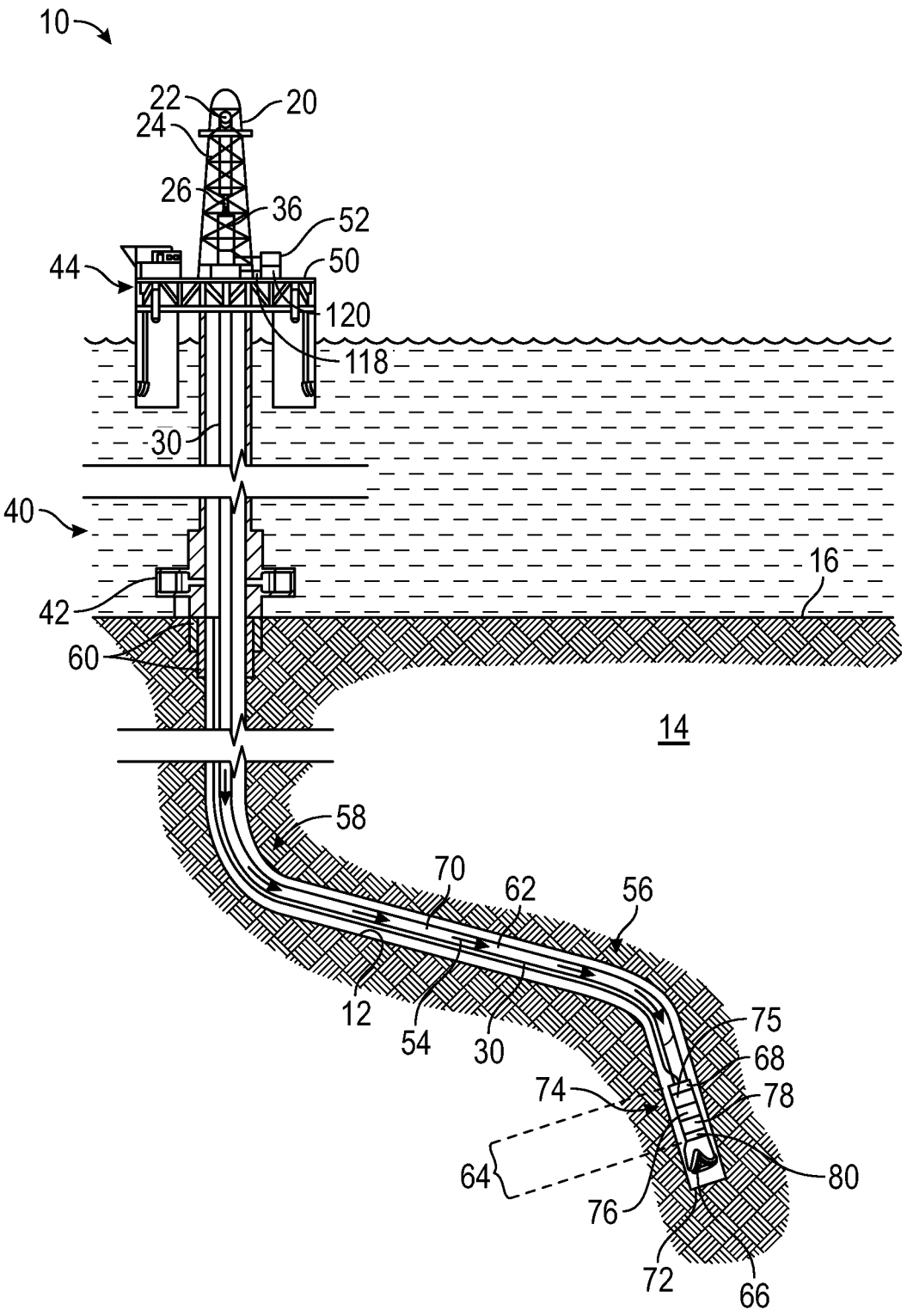
FIG. 2 is an elevation view in partial cross section of a marine-based well system with a flow control device for controlling downhole tools and equipment according to an embodiment.

Turning to FIGS. 1 and 2, shown is an elevation view in partial cross-section of a wellbore drilling and production system 10 utilized to produce hydrocarbons from wellbore 12 extending through various earth strata in an oil and gas formation 14 located below the earth's surface 16. Wellbore 12 may be formed of a single or multiple bores, extending into the formation 14, and disposed in any orientation. FIG. 1 shows system 10 in an on-shore environment and FIG. 2 shows system 10 in an off-shore environment.

Drilling and production system 10 includes a drilling rig or derrick 20. Drilling rig 20 may include a hoisting apparatus 22, a travel block 24, and a swivel 26 for raising and lowering casing, drill pipe, coiled tubing, production tubing, other types of pipe or tubing strings or other types of conveyance vehicles such as wireline, slickline, and the like 30. In FIG. 1, conveyance vehicle 30 is a substantially tubular, axially extending drill string formed of a plurality of drill pipe joints coupled together end-to-end, while in FIG. 2, conveyance vehicle 30 is completion tubing supporting a completion assembly as described below. Drilling rig 20 may include a kelly 32, a rotary table 34, and other equipment associated with rotation and/or translation of tubing string 30 within a wellbore 12. For some applications, drilling rig 20 may also include a top drive unit 36.

Drilling rig 20 may be located proximate to a wellhead 40 as shown in FIG. 1, or spaced apart from wellhead 40, such as in the case of an offshore arrangement as shown in FIG. 2. One or more pressure control devices 42, such as blowout preventers (BOPs) and other equipment associated with drilling or producing a wellbore may also be provided at wellhead 40 or elsewhere in the system 10.

For offshore operations, such as illustrated specifically in FIG. 2, whether drilling or production, drilling rig 20 may be mounted on an oil or gas platform 44, such as the offshore platform as illustrated, semi-submersibles, drill ships, and the like (not shown). Although system 10 of FIG. 2 is illustrated as being a marine-based production system, system 10 of FIG. 2 may be deployed on land. Likewise, although system 10 of FIG. 1 is illustrated as being a land-based drilling system, system 10 of FIG. 1 may be deployed offshore. In any event, for marine-based systems, one or more subsea conduits or risers 46 extend from deck 50 of platform 44 to a subsea wellhead 40. Tubing string 30 extends down from drilling rig 20, through subsea conduit 46 and BOP 42 into wellbore 12.

A working or service fluid source 52, such as a storage tank or vessel, may supply a working fluid 54 pumped by pump 55 to the upper end of tubing string 30 and flow through tubing string 30. Working fluid source 52 may supply any fluid utilized in wellbore operations, including without limitation, drilling fluid, cementious slurry, acidizing fluid, liquid water, steam or some other type of fluid.

Wellbore 12 may include subsurface equipment 56 disposed therein, such as, for example, a drill bit 66 and bottom hole assembly (BHA) 64, a completion assembly or some other type of wellbore tool.

Wellbore drilling and production system 10 may generally be characterized as having a pipe system 58. For purposes of this disclosure, pipe system 58 may include casing, risers, tubing, drill strings, completion or production strings, subs, heads or any other pipes, tubes or equipment that couples or attaches to the foregoing, such as string 30, conduit 46, collars, and joints, as well as the wellbore and laterals in which the pipes, casing and strings may be deployed. In this regard, pipe system 58 may include one or more casing strings 60 that may be cemented in wellbore 12, such as the surface, intermediate and production casings 60 shown in FIG. 1. An annulus 62 is formed between the walls of sets of adjacent tubular components, such as concentric casing strings 60 or the exterior of tubing string 30 and the inside wall of wellbore 12 or casing string 60, as the case may be.

Where subsurface equipment 56 is used for drilling and conveyance vehicle 30 is a drill string, the lower end of drill string 30 may include BHA 64, which may carry at a distal end a drill bit 66. During drilling operations, weight-on-bit (WOB) is applied as drill bit 66 is rotated, thereby enabling drill bit 66 to engage formation 14 and drill wellbore 12 along a predetermined path toward a target zone. In general, drill bit 66 may be rotated with drill string 30 from rig 20 with top drive 36 or rotary table 34, and/or with a downhole mud motor 68 within BHA 64. The working fluid 54 pumped to the upper end of drill string 30 flows through the longitudinal interior 70 of drill string 30, through bottom hole assembly 64, and exit from nozzles formed in drill bit 66. At bottom end 72 of wellbore 12, drilling fluid 54 may mix with formation cuttings, formation fluids and other downhole fluids and debris. The drilling fluid mixture may then flow upwardly through an annulus 62 to return formation cuttings and other downhole debris to the surface 16.

Bottom hole assembly 64 and/or drill string 30 may include various other tools 74, including a flow control device 75, a power source 76, mechanical subs 78 such as circulating subs and directional drilling subs, and sampling and/or measurement equipment 80, such as formation testing and sampling tools, measurement while drilling (MWD) and/or logging while drilling (LWD) instruments, detectors, circuits, or other equipment to provide information about wellbore 12 and/or formation 14, such as samples or logging or measurement data from wellbore 12. Measurement data and other information from tools 74 may be communicated using electrical signals, acoustic signals or other telemetry that can be converted to electrical signals at the rig 20 to, among other things, monitor the performance of drilling string 30, bottom hole assembly 64, and associated drill bit 66, as well as monitor the conditions of the environment to which the bottom hole assembly 64 is subjected.

Fluids, cuttings and other debris returning to surface 16 from wellbore 12 are directed by a flow line 118 to storage tanks 52 and/or processing systems 120, such as shakers, centrifuges and the like.

Flow control device 75 controls the flow of working fluid to the BHA 64. Flow control device 75 may be disposed above the BHA 64 or be part of the BHA 64. Power source 76 may be any power source standard in the art including, but not limited to, a battery and a power section having a stator and a rotor.

Figure 3:
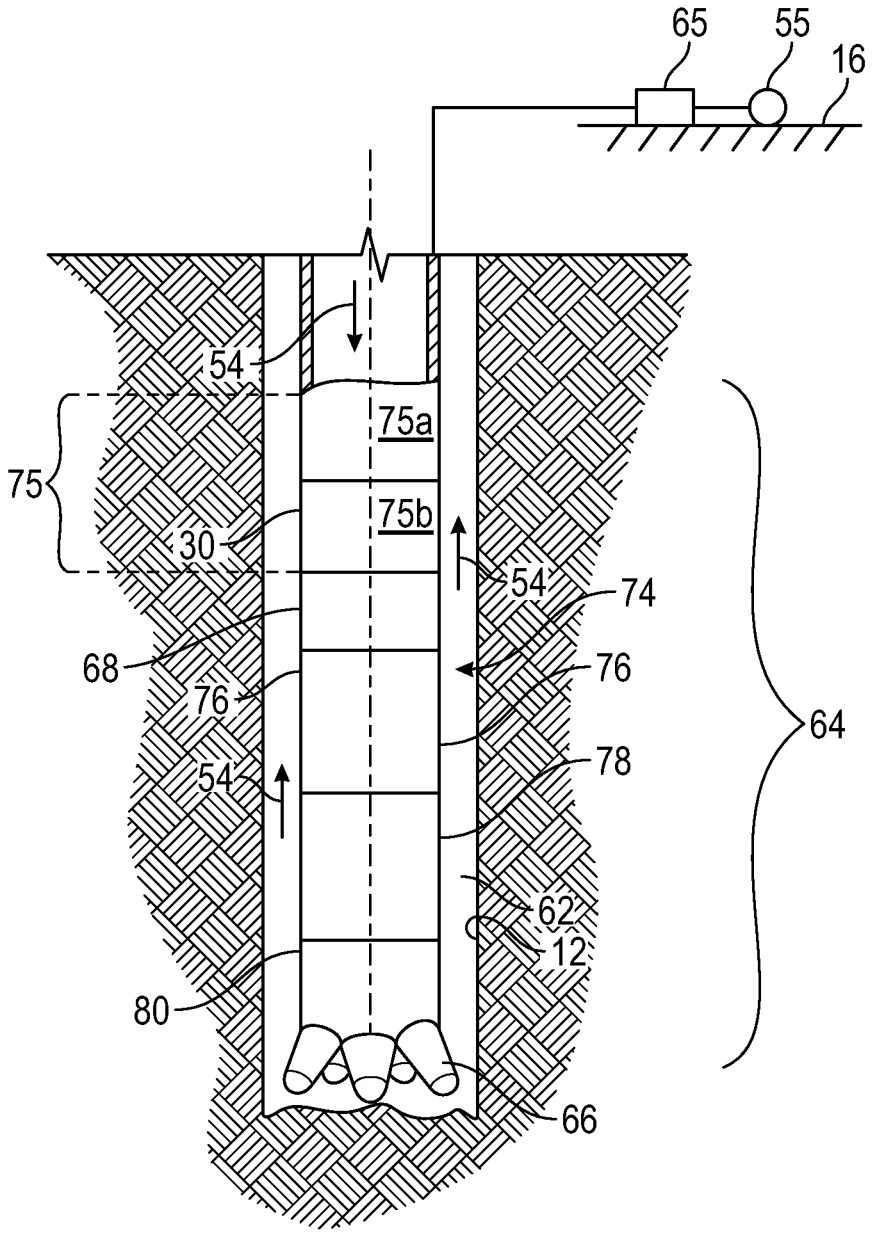
FIG. 3 is a sectional view of a portion of the well system of FIGS. 1 and 2 with a flow control device.

Turning to FIG. 3, illustrated is a front cross sectional view of a portion of the well system 10 of FIGS. 1 and 2 with control device 75 for controlling fluid flow to downhole tools 74 and equipment. More particularly, flow control device 75 includes an actuator assembly **75*a* and a flow diverter assembly 75*b*. Actuator assembly 75*a* is used to drive flow diverter assembly 75*b* between various configurations. A first configuration enables a first flow path and fluid communication through the interior of BHA 64 to equipment 74, such as power source 76; a second configuration enables a second flow path and fluid communication through the central bore of BHA 64 to equipment 74, such as sampling equipment 80; and a third configuration enable a third flow path and fluid communication to annulus 62 and the exterior of BHA 64. As described in more detail below, the actuator assembly 75***a* may be mechanically actuated or electronically actuated. In a mechanically actuated embodiment, changes in pressure of working fluid 54 pumped from the surface 16, as opposed to the prior art dropped ball, are used to control actuator assembly 75*a*, which in turn drives diverter assembly 75*b* to divert fluid flow from a central bore of the BHA 64 to the annulus 62, or to otherwise alter flow paths within BHA 64. It will be appreciated that when activated and controlled by flow control device 75, downhole tools 74, such as a circulating sub 78, may be located anywhere in relation to the BHA 64 since there are no inner diameter pipe restrictions typically required as with ball activators. An additional benefit of the arrangement described herein is that flow control device 75 allows the use of a mud motor 68 and a sampling device 80 in the same BHA 64.

Figure 4A:
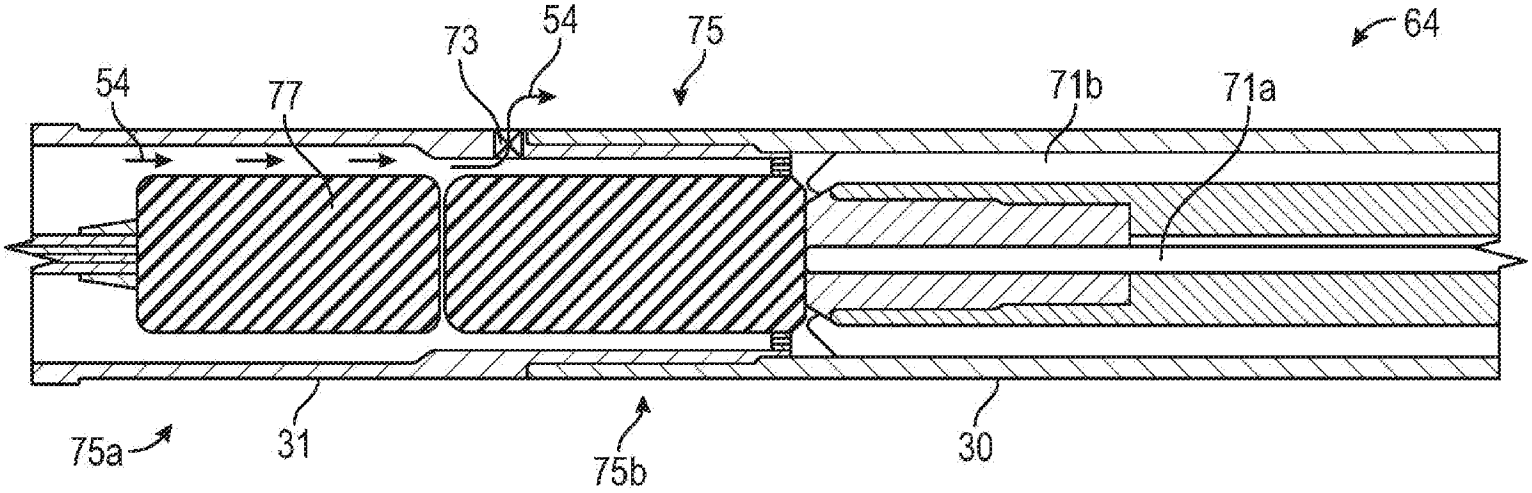
FIGS. 4A and 4B are a partial cross section views of a flow control device according to embodiments of FIG. 3.

FIG. 4A shows a mechanically actuated embodiment of the actuator assembly 75*a* shown in FIG. 3, where the actuator assembly 75*a* has a barrel cam 77 disposed within a housing 31 that forms a portion of a string (e.g., string 30 shown in FIG. 3). The barrel cam 77 may be any barrel cam standard in the art. In this embodiment, the actuator assembly 75*a* is activated by pressure changes in the working fluid 54. Such pressure change may be introduced by cycling the pumps that pump the working fluid 54 to flow diverter assembly 75*b*. In the illustrated embodiment, flow diverter assembly 75*b* can be actuated to direct flow of working fluid 54 between an exterior port 73, such as may be defined in housing 31 or along pipe string 30, and one or more internal flow pathways 71 within pipe string 30. For example, internal flow pathway 71 includes a first internal flow channel 71*a*, which may be a central longitudinal bore within pipe string 30 or more particularly a central bore, for example a central by-pass bore 985 (FIG. 9), within a BHA tool, and a second internal flow channel 71*b*, which may be a separate flow conduit within pipe string 30 or more particularly a BHA tool. In one or more embodiments, flow diverter assembly 75*b* can be actuated to open or close port 73 as desired to control flow of fluid 54 to the exterior of housing 31. FIG. 4A illustrates port 73 in an open position and illustrates flow to the exterior of housing 31. As used herein, cycling the pumps refers operating the pumps to apply a first fluid pressure that cause a first actuation of the barrel cam 77 and thereafter, operating the pumps to apply a second fluid pressure different than the first fluid pressure to cause a second actuation of the barrel cam 77. For example, the pumps may be actuated to increase the pressure of fluid 54 to a first pressure, and thereafter, pumping may be adjusted to allow the pressure of fluid 54 to be bled off or reduced to a second pressure.

Figure 4B:
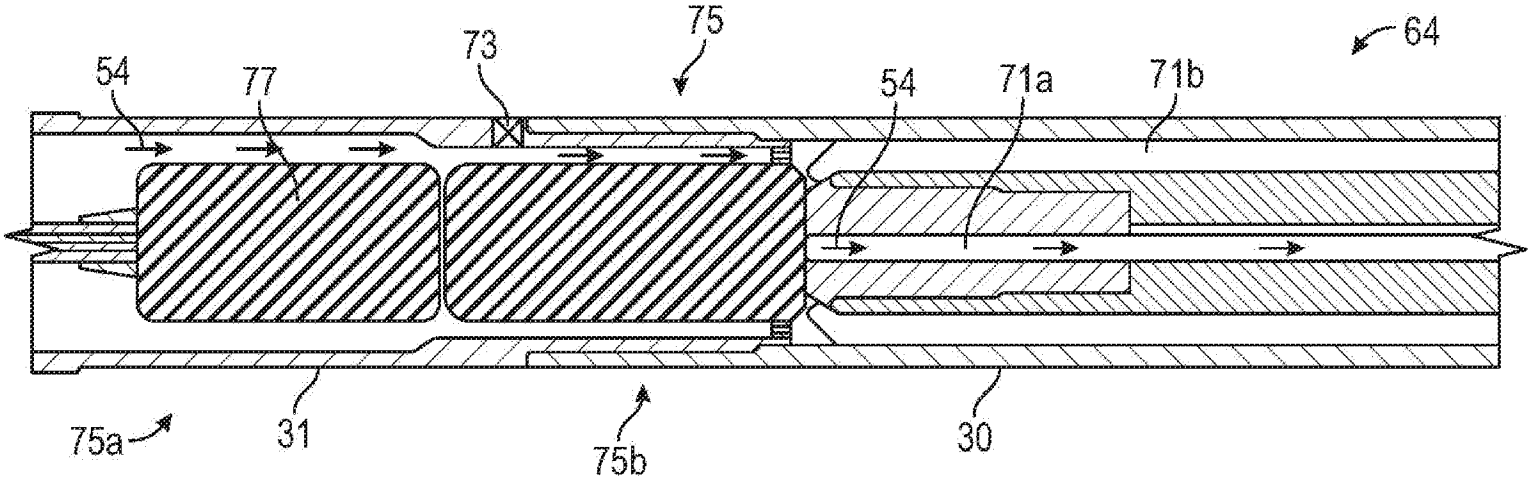

FIG. 4B shows another embodiment of the mechanically actuated actuator assembly 75*a* where barrel cam 77 is utilized to drive diverter assembly 75*b* to close off port 73 and to open an internal flow pathway 71 disposed within BHA 64. The barrel cam 77 may be any barrel cam standard in the art. In this embodiment, the actuator assembly 75*a* is activated by a pressure changes in the working fluid 54 as described above. For example, working fluid 54 pressure may be fled off from a first pressure to a second pressure, where the pressure change results in activation of barrel cam 77 that drives flow diverter assembly 75*b*

Figure 5:
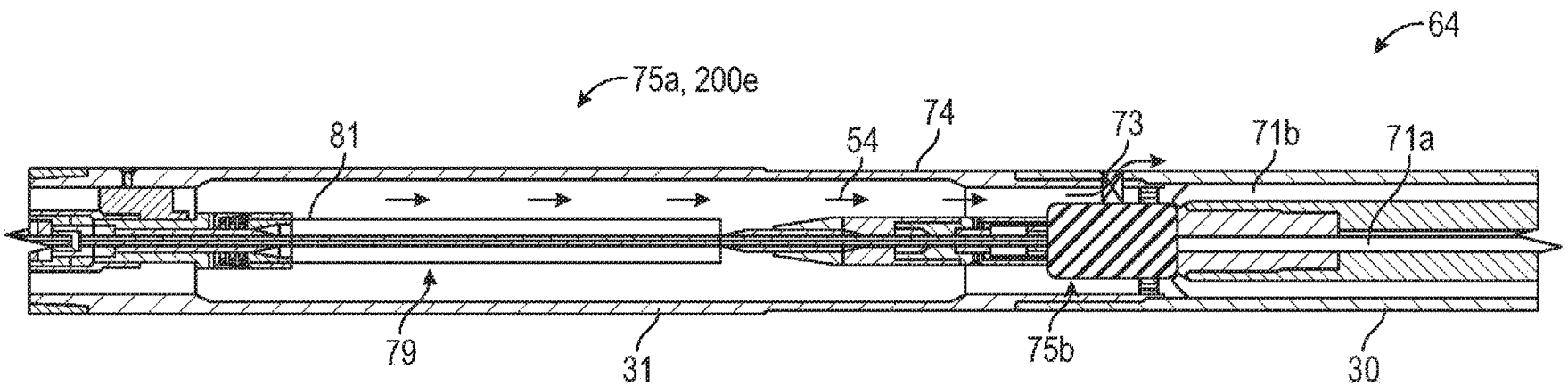
FIG. 5 is a partial cross section view of a flow control device according to an embodiment of FIG. 3.

FIG. 5 illustrates an electronically actuated embodiment of the actuator assembly 75*a* shown in FIG. 3. In particular, the actuator assembly 75*a* may include an electronic module 79 disposed within housing 31. In one or more embodiments, module 79 may be actuated by electronic control signals, such as electronic downlinks sent from a surface control unit or computer 65 at the surface 16 (FIG. 3). Actuation of the module 79 may be used to drive flow diverter assembly 75*b* to change the flow path of fluid 54 through BHA 64, altering between flow through port 73 and flow downstream to an internal flow pathway 71. In other embodiments, flow diverter assembly 75*a* may alter flow internally within pipe string 30 between a first flow channel 71*a* and a second flow channel 71*b*. In one or more embodiments, module 79 may include sensors or a sonde 81 which may be utilized in the operation of actuator assembly 75*a*. For example, the sonde 81 may be disposed within housing 31 so that fluid 54 flows over and around the sonde 81. In an embodiment, the electronic module 79 and/or sonde 81 may be insert-based with the electronic components disposed on the outside diameter of the tool 74 and fluid flowing through a bore in the electronics. In another embodiment, the electronic module 79 and/or sonde 81 may be outsert-based with the electronic components disposed in a pocket in the outer diameter of the tool 74 and fluid flowing through the tool 74 and back up the annulus by the electronics. In one or more embodiments, sonde 81 includes pressure sensors and may be used to detect pressure pulses or changes that can be utilized to actuate or otherwise control electronic module 79, and thereby, flow diverter assembly 75*b*.

Figure 6B:
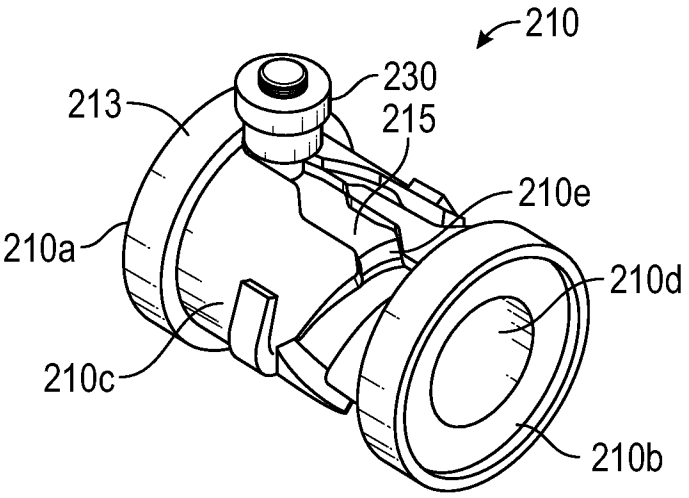
FIG. 6B is a perspective view of a barrel cam of the actuator assembly of FIG. 6A.
Figure 6A:
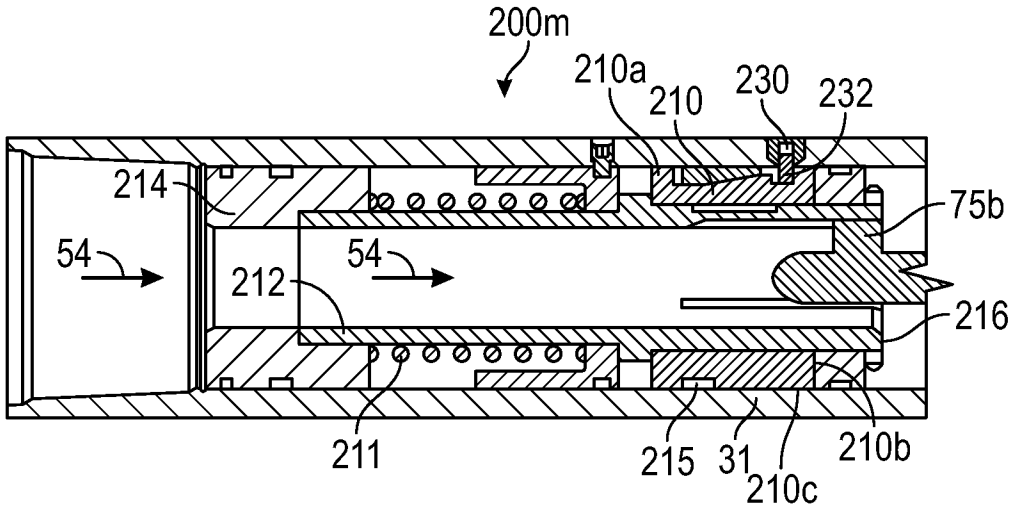
FIG. 6A is a partial cross section view of an actuator assembly of the flow control device of FIGS. 4A and 4B.

The mechanically actuated actuator assembly 75*a* described in FIGS. 4A and 4B as barrel cam 77 is illustrated more specifically in FIG. 6A and designated as actuator assembly 200*m*. In the illustrated embodiment, actuator assembly 200*m* includes a barrel cam 210 The barrel cam 210 is formed of a sleeve having an upper end 210*a*, a lower end 210*b*, and an outer surface 210*c*. The barrel cam 210 is carried on a barrel cam mandrel 212 having an upper end 214 and a lower end 216. The barrel cam 210 is attached to barrel cam mandrel 212 so that rotation of the barrel cam 210 results in rotation of the barrel cam mandrel 212. In other embodiments, the barrel cam 210 may be rotatably mounted on and about the barrel cam mandrel 212 and supported by thrust bearings to allow bearing cam 210 to rotate relative to the mandrel 212. The barrel cam 210 includes an indexing s groove 215 formed in the outer surface 210*c* and extending around the circumference of the barrel cam sleeve. In one or more embodiments, the indexing groove 215 is continuous about the circumference of the barrel cam sleeve. Actuator assembly 200*m* includes at least one barrel cam bushings or follower 230, which may be mounted on housing 31, and as such may be fixed relative to axial and rotational movement of barrel cam 210. Barrel cam follower 230 may include a barrel cam pin 232 which may be urged radially inward by a spring (not shown) so that barrel cam pin 232 protrudes into and engages the groove 215 of barrel cam 210.

Upper end 214 of mandrel 212 may generally act as a pressure surface against which working fluid 54 pumped down to actuator assembly 200*m* can interact, thereby applying an axial force in a downstream direction. Actuator assembly 200*m* further includes a spring 211 disposed to apply an axial force on barrel cam 210 and mandrel 212 in an upstream direction. Persons of skill in the art will appreciate that as the pressure of fluid 54 is increased to a degree that the downstream force applied to the upper end 214 of mandrel 212 is greater than the upward force of spring 211, mandrel 212 and barrel cam 210 will be translated axially in the downstream direction.

It will be appreciated that mandrel 212 may engage a flow diverter assembly 75*a* as desired in order to translate axial and rotational movement of the actuator assembly 200*m* to the flow diverter assembly 75*b*.

FIG. 6B is a perspective view of a portion of actuator assembly 200*m*. As illustrated, barrel cam 210 has an upper end 210*a*, a lower end 210*b*, and an outer surface 210*c*. A through bore 210*d* extends the length of barrel cam 210 between the two ends 210*a*, 210*b*. A groove 215 is formed in outer surface 210*c* and is disposed for receipt of a follower 230. In some embodiments, barrel cam 210 may include one or more bearings 213, such as the bearing surface 213 illustrated on each end 210*a*, 210*b* in FIG. 6B.

Figure 6C:
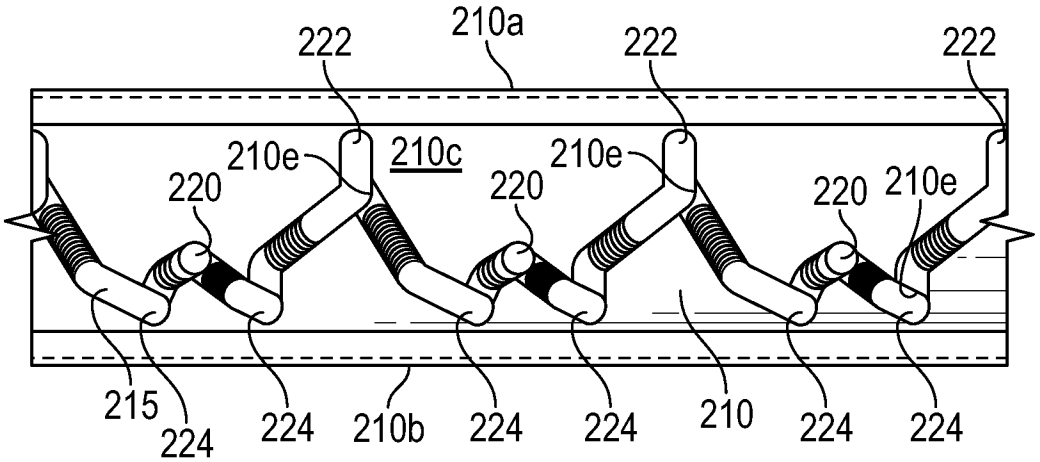
FIG. 6C is a flat view of an outer surface of the barrel cam of FIG. 6B.

FIG. 6C is a flat view of an outer surface of the barrel cam 210, where groove 215 is illustrated as continuous about the surface 210*c* with various locations 220, 222, 224 are illustrated along the length of groove 215. A first location 220 in the groove 215 corresponds to a first position of the mandrel 212. A second location 222 in the groove 215 corresponds to a second position of the mandrel 212. In an embodiment, the barrel cam 210 may be modified to actuate the downhole tool 74 to one or more intermediate positions by providing one or more intermediate positions in the groove 215, which may be located between the first location 220 and the second location 222. In an embodiment, the continuous groove 215 of the barrel cam 210 may include a third location 224 corresponding to a third position of the barrel cam mandrel 212. Thus, the full length of the groove 215 in the illustrated embodiment has three complete segments extending between a first location 220 and a second location 222, where each segment is representative of a cycle as will be described below. However, it will be appreciated that groove 215 may be modified to include fewer or more segments, resulting in fewer or more cycles, as desired.

In one or more embodiments, groove 215 varies in depth about the circumference of the barrel cam 210 such that step changes are provided in its depth to inhibit the barrel cam 210 from tracking along groove 215 in a reverse direction. In this regard, groove 215 may include ramps or inclines to vary the depth of groove 215. As a result of the depth changes, relative movement between the barrel cam 210 and the follower 230 is inhibited such that follower 230 can only track along groove 215 in a single direction in response to pressure changes in fluid 54.

In one or more embodiment, the variable depth groove 215 in the barrel cam 210 may include shoulders or steps 210*e* formed along its length to further constrain barrel cam pin 232 to track only in one direction along the groove 215 as barrel cam 210 is axially translated. Steps 210*e* prevent barrel cam pin 232 from tracking in the other direction along groove 215.

The mechanically actuated actuator assembly 200*m* moves through three complete actuation cycles for a single revolution of the barrel cam 210. In particular, in a single revolution of the barrel cam 210, the first location 220, the second location 222, and the intermediate location 224 of the barrel cam 210 will each be provided three times with the result that a single cycle will be completed in each 120 degrees of rotation of the barrel cam 210. In an embodiment, the barrel cam 210 may be used with various embodiments of the flow diverter assembly 300 described in further detail below.

Figure 7A:
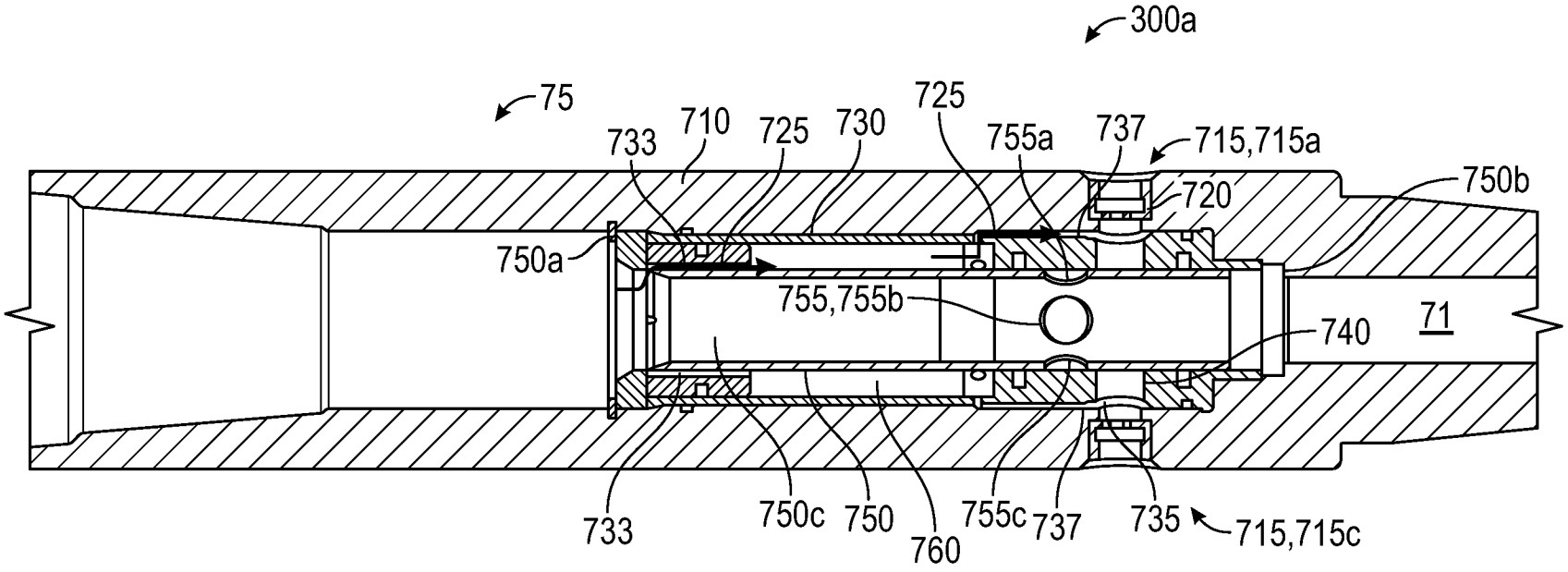
FIGS. 7A and 7B are partial cross section views of a flow diverter assembly according to an embodiment of FIG. 3.

The flow diverter assembly 75*a* described in FIGS. 4A and 4B is illustrated more specifically in FIG. 7A and designated as flow diverter assembly 300*a*, shown in an unactuated position. In the present embodiment, flow diverter assembly 300*a* is an axially reciprocating valve, but in other embodiments, the flow diverter assembly 300*a* may be any valve standard in the art including, but not limited to, a rotary valve, a gate valve, a ball valve, a butterfly valve, an aperture valve, and a poppet style valve. Flow diverter assembly 300*a* includes a tubular housing 710 having one or more ports 715 and an intermediate housing 730 having one or more ports 735, with intermediate housing 730 disposed inside and stationary relative housing 710. In the present embodiment, the housing 710 includes four ports 715*a*, 715*c* (remaining two ports not shown) circumferentially spaced about housing 710, and intermediate housing 730 includes four ports 735*a*, 735*c* (remaining two ports not shown) circumferentially spaced about intermediate housing 730. Each port 715 in housing 710 can be in fluid communication with each port 735 in the intermediate housing 730 via a passage 720. Housing 710 also illustrates an internal flow pathway 71 downstream of ports 715.

Flow diverter assembly 300*a* further includes a sleeve 750 comprising a first end 750*a*, a second end 750*b*, and an outer cylindrical surface 750*c* having one or more ports 755. Sleeve 750 is disposed in intermediate housing 730 and defines a chamber 760 between outer surface 750*c* and intermediate housing 730. In the present embodiment, sleeve 750 includes four ports 755*a*, 755*b*, 755*c* (fourth port not shown) circumferentially spaced about outer surface 750*c* of sleeve 750. A passage 740 disposed in intermediate housing 730 in in fluid communication with port 735 and with passage 720 and, subsequently, in fluid communication with port 715 in housing 710.

The sleeve 750 is oriented in the housing 710 and intermediate housing 730 such that ports 755 on the inner mandrel 750 may be radially aligned with ports 735 in intermediate housing 730 and, subsequently, aligned with ports 715 in the housing 710. The ports 755 in the sleeve 750 are axially offset from the ports 735 in the intermediate housing 730 and the ports 715 in the housing 710 when the sleeve 750 is in a first or unactuated position, as shown. In an embodiment, housing 710, intermediate housing 730, and sleeve 750 may each have as few as one port 715, 735, 755, respectively, or may each have as many as two, three, five or more ports 715, 735, 755, respectively.

The flow diverter assembly 300*a* may have two or more fluid flow paths. Flow diverter assembly 300*a* may comprise any valve standard in the art including, but not limited to, a rotary valve, a reciprocating valve, a gate valve, a ball valve, a butterfly valve, an aperture valve, and a poppet style valve. A first flow path 725 passes through one or more upper channels 733 formed in intermediate housing 730, and may be circumferentially spaced apart in intermediate housing 730 when the sleeve 750 is in the first or unactuated position. The first flow path 725 also includes chamber 760 as well as one or more lower channels 737 formed in intermediate housing 730, and may be circumferentially spaced apart in intermediate housing 730.

Figure 7B:
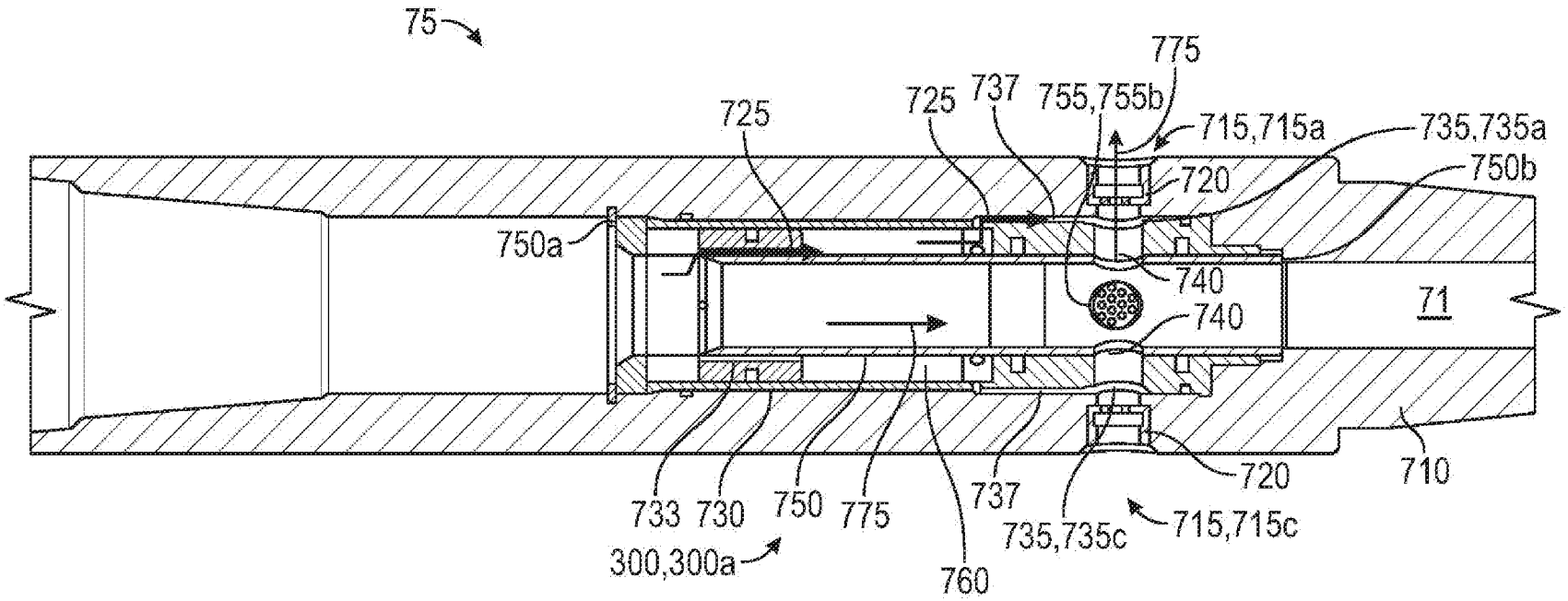

Turning to FIG. 7B, shown is the flow diverter assembly 300*a* of FIG. 7A, but in an actuated position. The ports 755 in the sleeve 750 are substantially aligned with the ports 735 in the intermediate housing 730 and, subsequently, substantially aligned with ports 715 in housing 710 when the sleeve 750 is in a second or actuated position. In an embodiment, the ports 715, 735, 755 may substantially overlap when aligned or may only partially overlap when aligned to allow less fluid flow therethrough. A second flow path 775 passes through the interior of sleeve 750 and out through port 755 in sleeve 750, passageway 740, port 735 in intermediate mandrel 730, passageway 720, port 715 in housing 710, and out to the exterior of housing 710 when the sleeve 750 is in the second or actuated position. Housing 710 also illustrates an internal flow pathway 71 downstream of ports 715. In an alternative embodiment, the second flow path may direct fluid flow to internal flow pathway 71 instead In an embodiment, the flow diverter assembly 300*a* may be used with a mechanical actuated actuator (e.g., mechanically actuated actuator assembly 200*m*, shown in FIG. 6A) having a barrel cam (e.g., barrel cam 210, shown in FIGS. 6A-6C) that moves both axially and rotationally to position a barrel cam pin (e.g., barrel cam pin 232, shown in FIG. 6A) at one of a first, second, or third location (e.g., first, second, and third locations 220, 222, 224, respectively, shown in FIG. 6C) in the barrel cam in response to pressure changes in the working fluid when the pumps at surface are turned on and off, or when the pumps are cycled to reduce or increase the mud pump flow rate. Moving the barrel cam axially and rotationally to place the barrel cam pin in the various locations actuates the flow diverter assembly 300 from one flow path to another flow path. For example, axial motion of the barrel cam aligns the ports 735, 755 when the barrel cam pin is in the first position and misaligns the ports 735, 755 when the barrel cam pin is in the second position or the third position. The amount of misalignment of ports 735, 755 may be complete (no overlap) or partial. Alternative configurations of the actuator assembly may, however, be employed with regard to the overall configuration of the tool, the first flow path 725, and the second flow path 775.

In an embodiment, the flow diverter assembly 300*a* may be used with an electronically actuated actuator (e.g., electronically actuated actuator assembly 200*e*, shown in FIG. 5), where instructions for the actuation of the flow diverter assembly 300*a* are sent from surface control unit 65 at surface 16 (FIG. 3) to change between flow paths 725, 775 by either aligning or misaligning, in any proportion, ports 735, 755 in the first embodiment of flow diverter assembly 300*a*.

Figure 8A:
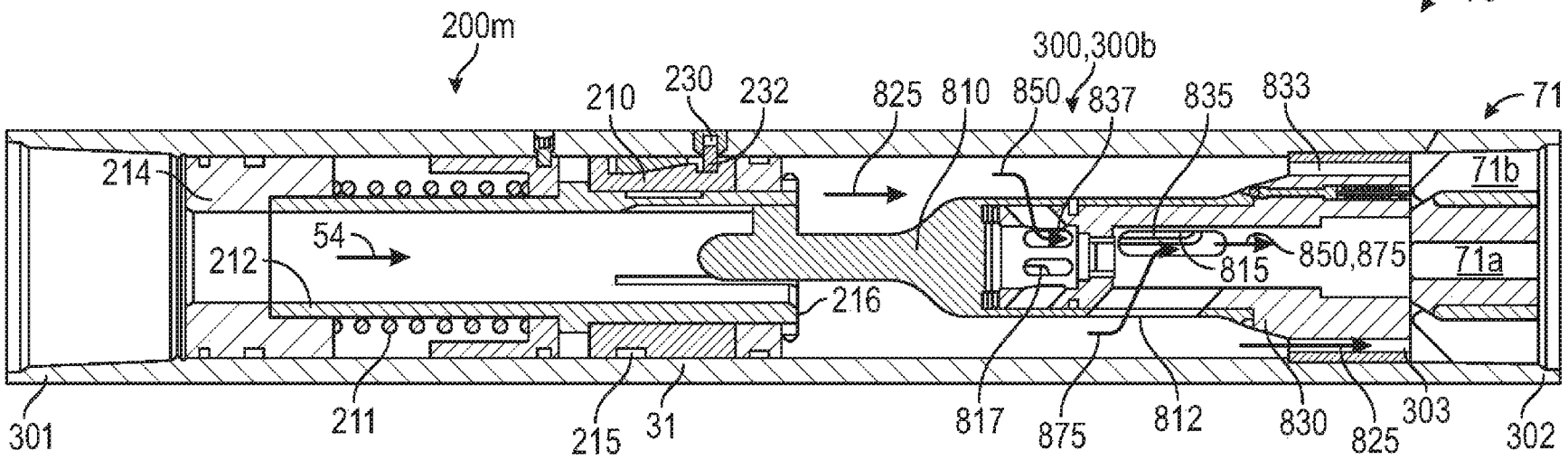
FIG. 8A is a partial cross section view of a flow diverter assembly according to an embodiment of FIG. 3.

The flow diverter assembly 300*a* described in FIGS. 7A and 7B is illustrated in another embodiment in FIG. 8A and designated as flow diverter assembly 300*b*. In the present embodiment, flow diverter assembly 300*b* is a rotary valve, but in other embodiments, the flow diverter assembly 300*b* may be any valve standard in the art including, but not limited to, an axially reciprocating valve, a gate valve, a ball valve, a butterfly valve, an aperture valve, and a poppet style valve. In particular, the flow diverter assembly 300*b* comprises a first flow control valve member 810 defining a first member primary bypass port 815, which comprises a plurality of discrete apertures spaced circumferentially around a lower section 812 of the first flow control valve member 810. The first flow control valve member 810 also defines a first member secondary bypass port 817, which comprises a plurality of discrete apertures spaced circumferentially around the lower section 812 of the first flow control valve member 810.

The flow diverter assembly 300*b* also comprises second flow control valve member 830 defining a second member primary bypass port 835, which comprises a plurality of discrete ports spaced circumferentially around the second flow control valve member 830. The second flow control valve member 830 also defines a second member secondary bypass port 837, which comprises a plurality of discrete ports spaced circumferentially around the second flow control valve member 830.

The first flow control valve member 810 may rotate relative to the second flow control valve member 830 to selectively align and/or misalign the primary bypass ports 815, 835 and/or the secondary bypass ports 817, 837. In an embodiment, either or both of the valve members 810, 830 may be configured to rotate.

Referring still to FIG. 8A, the primary bypass ports 815, 835 may be comprised of any number of apertures and/or ports. In an embodiment, the number of apertures comprising the first member primary bypass port 815 is the same as the number of ports comprising the second member primary bypass port 835. Similarly, in an embodiment, the secondary bypass ports 817, 837 may be comprised of any number of apertures and/or ports. Similarly, in an embodiment, the number of apertures comprising the first member secondary bypass port 817 may comprise the same number of ports as the second member secondary bypass port 837. In an embodiment, the first member primary bypass port 815 may be comprised of three apertures, the second member primary bypass port 835 may be comprised of three ports, the first member secondary bypass port 817 may be comprised of six apertures, and the second member secondary bypass port 837 may be comprised of six ports.

In an embodiment, the flow diverter assembly 300*b* may be used with a mechanically actuated actuator, such as mechanically actuated actuator assembly 200*m*. In the illustrated embodiment, actuator assembly 200*m* includes a barrel cam 210 disposed within housing 31 between first and second ends 301, 302 of the housing 31. The barrel cam 210 is carried on a barrel cam mandrel 212 having an upper end 214 and a lower end 216. The barrel cam 210 is attached to barrel cam mandrel 212 so that rotation of the barrel cam 210 results in rotation of the barrel cam mandrel 212. The barrel cam 210 is formed of a sleeve having a continuous groove 215 formed around the circumference of the sleeve. Actuator assembly 200*m* includes at least one barrel cam bushings or follower 230, which may be mounted on housing 31. Barrel cam follower 230 may include a barrel cam pin 232 which may be urged radially inward by a spring (not shown) so that barrel cam pin 232 protrudes into and engages the groove 215 of barrel cam 210.

Upper end 214 of mandrel 212 may generally act as a pressure surface against which working fluid 54 pumped down to actuator assembly 200*m* can interact, thereby applying an axial force in a downstream direction. Actuator assembly 200*m* further includes a spring 211 disposed to apply an axial force on barrel cam 210 and mandrel 212 in an upstream direction. Persons of skill in the art will appreciate that as the pressure of fluid 54 is increased to a degree that the downstream force applied to the upper end 214 of mandrel 212 is greater than the upward force of spring 211, mandrel 212 and barrel cam 210 will be translated axially in the downstream direction. Moreover, as mandrel 212 and barrel cam 210 translate axially, barrel cam 210 and follower 230 function to cause rotational movement of mandrel 212 and barrel cam 210 as well.

As shown, mandrel 212 may engages control valve member 810 in order to translate axial and rotational movement of the actuator assembly 200*m* to the flow diverter assembly 300*b*. Thus, rotational motion of a barrel cam 210 aligns the primary bypass ports 815, 835 when a barrel cam pin (e.g., barrel cam pin 232, shown in FIG. 6A) of the actuator assembly is in a first position (e.g., first location 220, shown in FIG. 6C) and misaligns the primary bypass ports 815, 835 when the barrel cam pin is in a second position (e.g., second location 222, shown in FIG. 6C) or a third or intermediate position (e.g., third location 224, shown in FIG. 6C). In addition, the secondary bypass ports 817, 837 are aligned when the barrel cam pin is in the third or intermediate location and are misaligned when the barrel cam pin is in the first location or the second location. Alternative configurations of the actuator assembly may, however, be employed with regard to the overall configuration of the tool, the first flow path 825, and the second flow path 875.

In an embodiment, the flow diverter assembly 300*b* may be used with an electronically actuated actuator (e.g., electronically actuated actuator assembly 200*e*, shown in FIG. 5), where instructions for the actuation of the flow diverter assembly 300*b* are sent from surface control unit 65 at surface 16 (FIG. 3) to change between flow paths 825, 875 by either aligning or misaligning, in any proportion, ports 815, 835 and 817, 837.

Figure 8B:
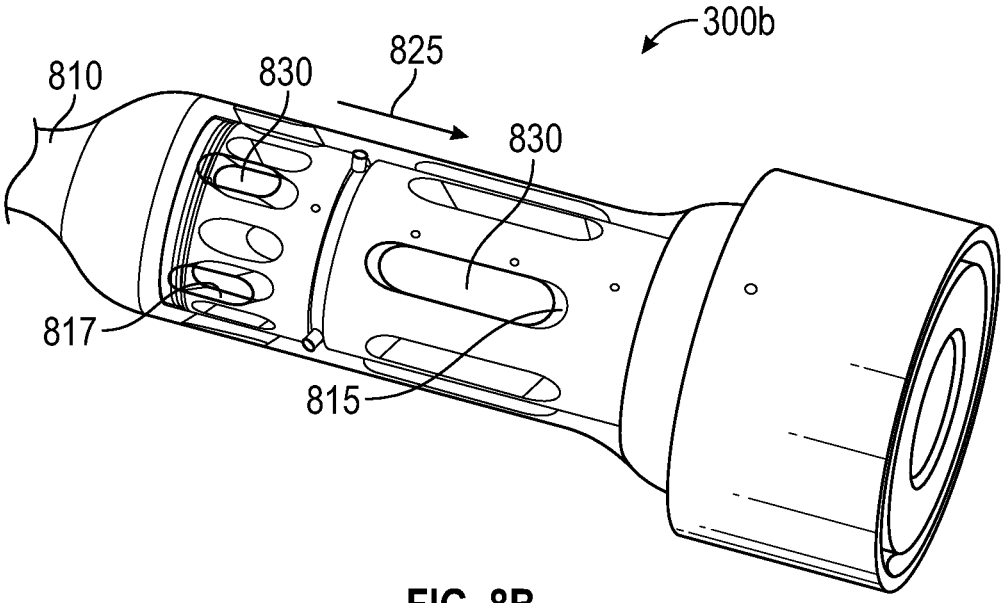
FIGS. 8B-8D are partial side views of a portion of the flow diverter assembly of FIG. 8A.

Turning now to FIG. 8B, shown is an embodiment of the flow diverter assembly 300*b* of FIG. 8A having three different positions to provide three fluid flow paths. A first flow path 825 passes around first flow control valve member 810, lower section 812, and second flow control valve member 830 in housing 31 when the flow control mechanism 300*b* is in a first position. Fluid flow is prevented from entering primary bypass ports 815, 835 and secondary bypass ports 817, 837, and instead continues through one or more channels 833 formed in second flow control valve member 830. The first flow path 825 continues from channels 833 through a first port 303 to the power source in tubing string.

Figure 8C:
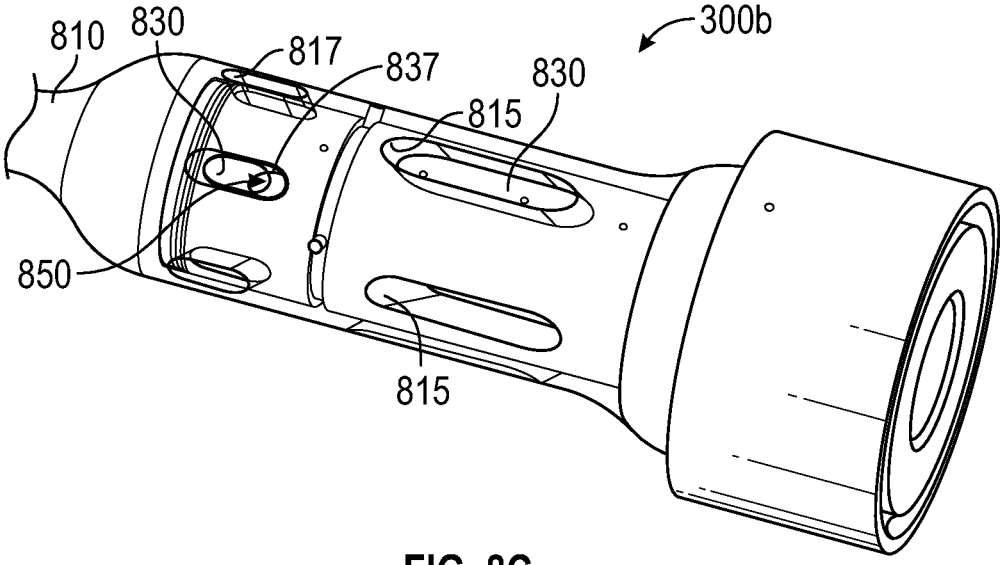

Referring now to FIG. 8C, shown is a second flow path 850 that passes through the interior of the valve members 810, 830, and continues through a central bore of second flow control valve member 830 and on to a central bore of the tubing string when the flow control mechanism 300*b* is in a second. When the flow control mechanism 300*b* is in the second position, secondary bypass ports 817, 837 are in alignment with one another while primary bypass ports 815, 835 are not aligned with one another, allowing fluid flow through secondary bypass ports 817, 837 while preventing fluid flow through primary bypass ports 815, 835. Second flow path 850 enters secondary bypass ports 817, 837 and continues through the central bore of second flow control valve member 830. In an alternative embodiment, the second flow path 850 may direct fluid flow out to the annulus.

Figure 8D:
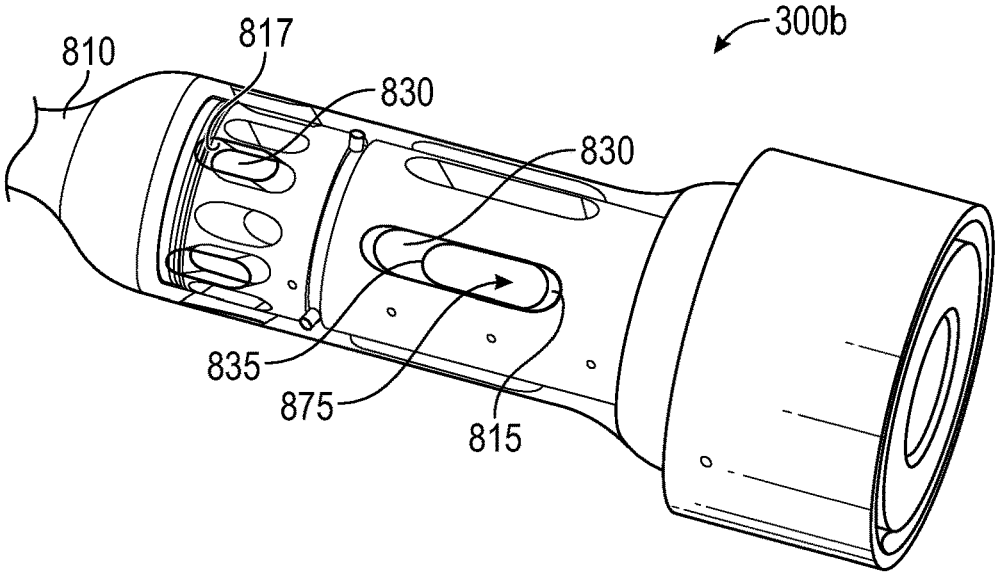

Turning now to FIG. 8D, illustrated is a third flow path 875 that passes through the interior of the valve members 810, 830, and continues through the central bore of second flow control valve member 830 and on to the central bore of the tubing string when the flow control mechanism 300*b* is in a third position. When the flow control mechanism 300*b* is in the third position, primary bypass ports 815, 835 are in alignment with on another while secondary bypass ports 817, 837 are not aligned with one another, allowing fluid flow through primary bypass ports 815, 835 while preventing fluid flow through secondary bypass ports 817, 837. Third flow path 875 enters primary bypass ports 815, 835 and continues through the central bore of second flow control valve member 830. In an alternative embodiment, the third flow path 875 may direct fluid flow out to the annulus. In an embodiment, the flow diverter assembly 300*b* may have two fluid flow paths or more than three fluid flow paths.

Figure 9:
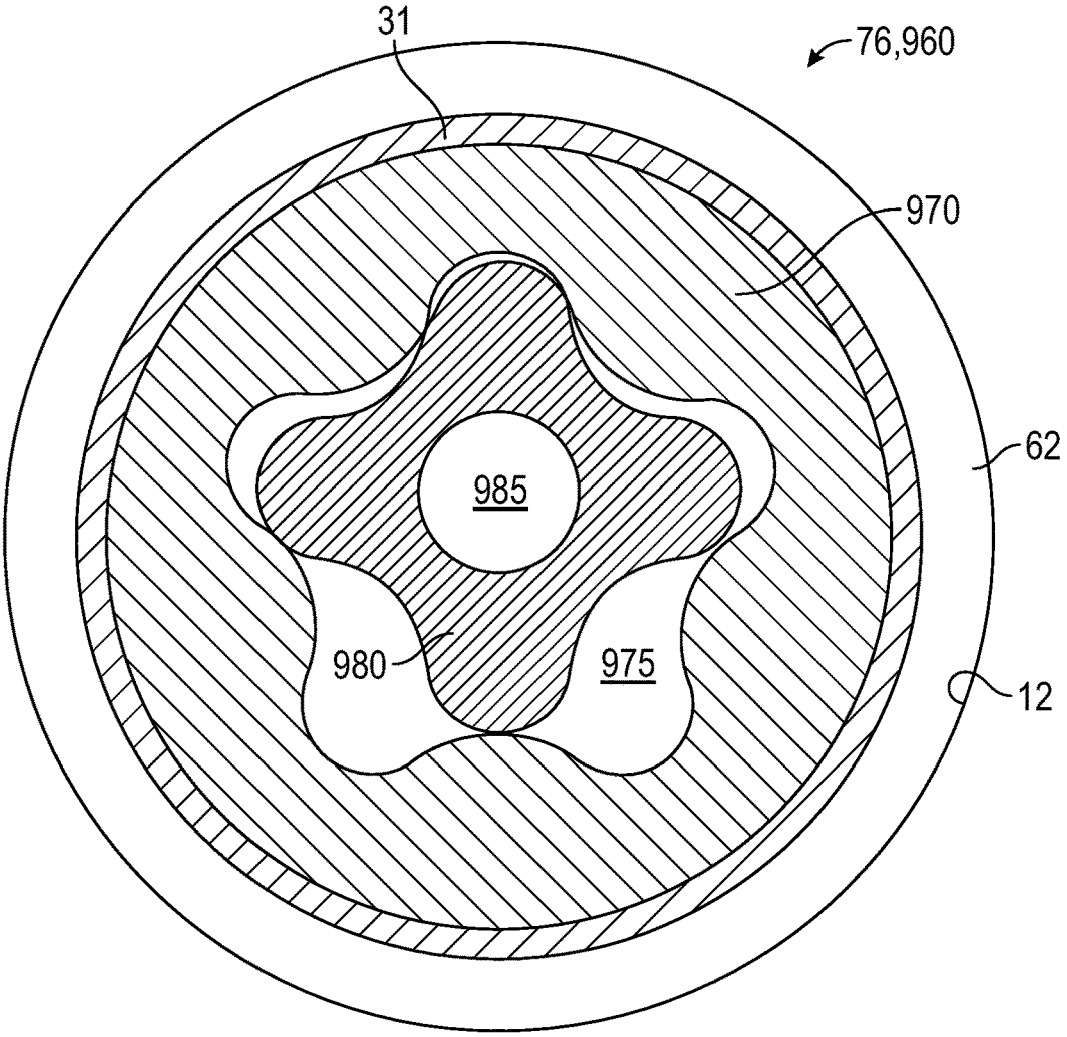
FIG. 9 is a cross section view of a power source according to an embodiment.

Referring now to FIG. 9, shown is a cross section view of a power section 960 such as was generally described in FIG. 3 as power source 76. As previously described, the flow diverter assembly alters the flow path of the working fluid by selectively directing a portion or all of the working fluid to various flow paths. All or a portion of working fluid may be directed to various tools in the BHA (e.g., tools 74 in BHA 64, shown in FIG. 3). In the illustrated embodiment, power section 960 is shown having a stator 970 and a rotor 980, where fluid flow can be directed as a first flow path to the space 975 between the stator 970 and the rotor 980 to actuate the rotor 980. Rotor 980 further comprises a central by-pass bore 985 through rotor 980. By-pass bore 985 may be a central through bore which functions as a second flow path for the working fluid. This second flow path can be used to by-pass the stator 970 and rotor 980 in instances where it is desired to pass the working fluid past the power section 960 without activating the power section 960, such as to formation testing and sampling tools (not shown) downstream of the power section 960. Thus, the foregoing will permit a power section 960 to be deployed in the same BHA as formation testing and sampling tools with selective activation and de-activation of the power section 960 as desired to inhibit interference with various formation testing and sampling tools and equipment adjacent the power section 960 in a BHA. In cases where it is desirable to actuate the formation testing and sampling tools, the power section 960 can be selectively de-activated. In one or more embodiments, all or a portion of working fluid may be directed to the power section 960, the bore 985 of the rotor 980, the annulus, or any combination thereof. In some embodiments, working fluid may be routed through the flow diverter assembly to the stator 970 of the power section 960 or alternatively, to the bore 985 formed within the rotor 980 for delivery to tool downhole from the power section 960. In other embodiments, the working fluid may also be split in any proportion between both the stator 970 of the power section 960 and the rotor through bore 985. For example, see the embodiment of flow diverter assembly 300 shown in FIG. 8A. In an embodiment, working fluid may be routed through the flow diverter assembly to the power section 960 or to the annulus; the working fluid may also be split in any proportion between both the power section 960 and the annulus. For example, see the embodiment of flow diverter assembly 300 shown in FIG. 7A.

In the electrically actuated embodiment 200*e* (FIGS. 3 and 5), instructions for the actuation of flow diverter assembly 300 are sent from surface control unit 65 at surface 16 (FIGS. 1-3) to change between flow paths 725, 775 by either aligning or misaligning, in any proportion, ports 735, 755 in the first embodiment of flow diverter assembly 300*a* (FIGS. 7A-7B) or to change between flow paths 825, 875 by either aligning or misaligning, in any proportion, ports 815, 835 and 817, 837 in the second embodiment of flow diverter assembly 300*b* (FIG. 8).

Figure 10:
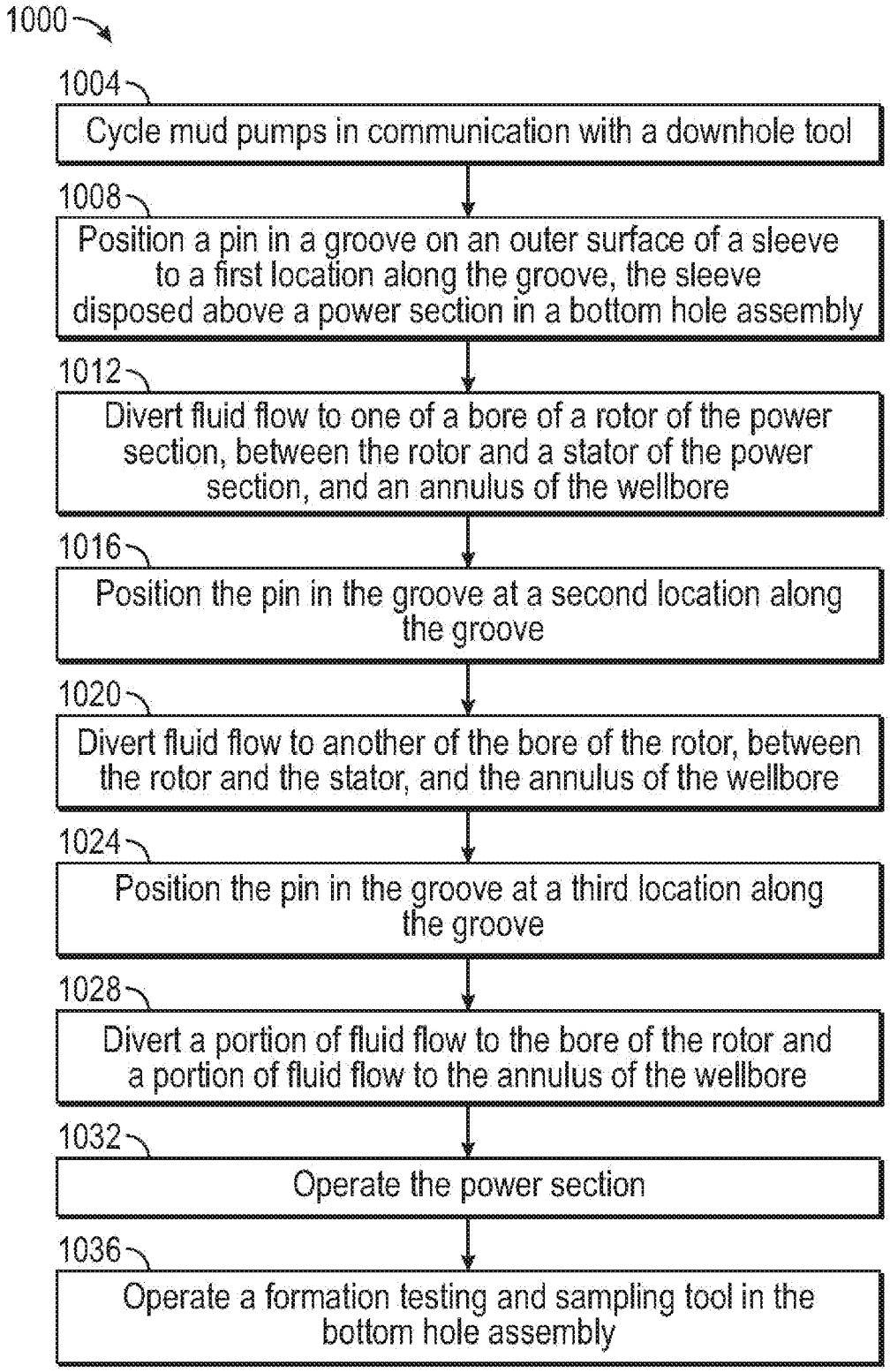
FIG. 10 is flow chart of a method for activating a downhole tool according to an embodiment.

In an exemplary embodiment and as illustrated in FIG. 10, a method 1000 of activating and/or controlling downhole tools and equipment is described. The method 1000 may be utilized for activating and/or controlling downhole tools and equipment by diverting working fluid to various flow paths.

In a first step 1004, mud pumps 55 at the surface 16 that are in fluid communication with downhole tools 74 are cycled (FIG. 3). In step 1008, a barrel cam pin 232 disposed in a groove 215 on an outer surface 210*c* of a housing 210 is positioned at a first location 220 (FIGS. 6A-6C), where the housing 210 is disposed above a power section 960 (FIG. 9) in a bottom hole assembly. Positioning and re-positioning, i.e., indexing, barrel cam pin 232 at various locations along groove 215 is accomplished by utilizing opposing axial forces from spring 211 and working fluid pressure to cause the barrel cam 210 to translate axially. The axial translation forces barrel cam 210 to rotate as groove 215 is engaged by fixed cam pin 232. In step 1012, fluid flow is diverted based on the movement of the barrel cam 210. In particular, fluid flow may be directed to one of a bore 985 defined in rotor 980 of the power section 960; the stator 970 of the power section 960; and an exterior annulus of the wellbore (FIG.

9). In step 1016, the barrel cam pin 232 is re-positioned in the groove 215 to a second location 222 (FIG. 6C) along groove 215. In step 1020, fluid flow is diverted to another of the bore 985 of rotor 980; the stator 970, and the annulus of the wellbore. In step 1024, the barrel cam pin 232 is re-positioned in the groove 215 at a third location 224 (FIG. 6C) along groove 215. In step 1028, a portion of fluid flow is diverted to the bore 985 of rotor 980 and a portion of fluid flow is diverted to the annulus of the wellbore. In step 1032, the power section 960 is operated utilizing fluid diverted to the stator 970. In step 1036, a formation testing and sampling tool 80 in the BHA 64 is operated (FIG. 3) utilizing fluid diverted to and through the bore 985 of rotor 980. In one or more embodiments, power section 960 and formation testing and sampling tool 80 may be operated simultaneously. It will be appreciated that because power section 960 and formation testing and sampling tool 80 are carried together on the same string 30 so that they may be actuated as desired utilizing the actuator assembly and flow diverter assembly as described herein.

Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

Thus, a flow control device for a downhole tool in a wellbore has been described. Embodiments of the flow control device may generally include a housing having a first end, a second end, and an outer surface having a groove, a follower having a pin slidably disposed in the groove, and a first and second port disposed on the outer surface of the cylindrical housing in fluid communication with a flow diverter assembly, wherein fluid flows through a bore of a rotor of a bottom hole assembly when the pin is in a first location, wherein fluid flows to an annulus of the wellbore when the pin is in a second location. In other embodiments, the control device for a downhole tool in a wellbore includes a housing having a first end, a second end, and an outer surface having a groove; a follower having a pin slidably disposed in the groove; and a first and second port disposed on the outer surface of the cylindrical housing in fluid communication with a flow diverter assembly; wherein fluid flows through a bore of a rotor of a bottom hole assembly when the pin is in a first position; and wherein fluid flows to an annulus of the wellbore when the pin is in a second position. Similarly, a system for drilling a wellbore has been described and includes a rotary steerable system having a power section; a bottom hole assembly having a formation testing and sampling tool; a flow diverter assembly; and a control device in communication with the flow diverter assembly.

For any of the foregoing embodiments, the flow control device may include any one of the following elements, alone or in combination with each other:

The pin is re-positioned between the first and second locations by cycling mud pumps at the surface.

The flow control device is disposed above the bottom hole assembly.

The flow control device is part of the bottom hole assembly.

The downhole tool is a circulation sub.

A portion of fluid flows through the bore of the bottom hole assembly and a portion of fluid flows to the annulus of the wellbore when the pin is in a third location.

The first location of the pin is associated with a first fluid path through the flow diverter assembly.

The first and second ports are spaced 180 degrees apart.

One of the first and second ports is in fluid communication with the bore of the bottom hole assembly, and the other of the first and second ports is in fluid communication with the annulus of the wellbore.

The bottom hole assembly includes a power section and a formation testing and sampling tool that operate in unison.

The flow diverter assembly includes a poppet-style valve or a reciprocating valve.

A system for drilling a wellbore has been described. The system may generally include a rotary steerable system including a power section, a bottom hole assembly including a formation testing and sampling tool, a flow diverter assembly, and a control device in communication with the flow diverter assembly.

For any of the foregoing embodiments, the system may include any one of the following elements, alone or in combination with each other.

The control device includes a sonde in communication with the flow diverter assembly and the surface, wherein fluid flows between a rotor and a stator of the power section when the flow diverter assembly is in a first position, wherein fluid flows to an annulus of the wellbore when the flow diverter assembly is in a second position.

The control device includes a sonde in communication with the flow diverter assembly and the surface, wherein fluid flows through a bore of a rotor when the flow diverter assembly is in a first position, wherein fluid flows between the rotor and a stator of the power section when the flow diverter assembly is in a second position.

The control device includes an insert-based electronic device in communication with the flow diverter assembly and the surface, wherein fluid flows through a bore of a rotor when the pin is in a first location, wherein fluid flows between the rotor and a stator of the power section when the pin is in a second location.

The control device includes a cylindrical housing having a first end, a second end, and an outer surface having a groove, a pin having a portion slidably disposed in the groove, and a first and second port disposed on the outer surface of the housing in fluid communication with the diverter valve, wherein fluid flows through a bore of a rotor when the pin is in a first location, wherein fluid flows between the rotor and a stator of the power section when the pin is in a second location.

The pin is re-positioned between the first and second locations by cycling mud pumps at the surface.

The control device is disposed above the bottom hole assembly.

The control device is part of the bottom hole assembly.

A portion of fluid flows through the bore of the rotor and a portion of fluid flows between the rotor and the stator of the power section when the pin is in a third location.

The power section may be rotating or stationary while the formation testing and sampling tool is in operation.

A method for activating a downhole tool has been described. The method may generally include cycling mud pumps in communication with the downhole tool, moving a follower pin in a groove on an outer surface of a housing to a first location, the housing disposed above a power section in a bottom hole assembly, and diverting fluid flow to one of a bore of a rotor of the power section, between the rotor and a stator of the power section, and an annulus of the wellbore. In other embodiments, the method may include altering drilling fluid pressure in a wellbore; using the change in the drilling fluid pressure to index a pin in a groove on an outer surface of a housing between at least a first location along the groove and a second location along the groove, the sleeve disposed above a power section in a bottom hole assembly, wherein the first location of the pin correlates to a first position of the housing and the second location of the pin correlates to a second position of the housing; and diverting drilling fluid flow to a wellbore annulus when the pin is at a first location along the groove and utilizing drilling fluid flow to drive the power section when the pin is a second location along the groove.

For the foregoing embodiments, the method may include any one of the following steps, alone or in combination with each other:

Moving the follower pin in the groove to a second location.

Diverting fluid flow to another of the bore of the rotor, between the rotor and the stator, and the annulus of the wellbore.

Positioning the follower pin in the groove at a third location.

Diverting a portion of fluid flow to the bore of the rotor and a portion of fluid flow to the annulus of the wellbore.

Operating the power section.

Simultaneously operating a formation testing and sampling tool in the bottom hole assembly.

Altering drilling fluid pressure again to index the pin in the groove between the second location and the first location; when the housing is in the second position, establishing fluid communication with another of the bore of the rotor, the stator of the power section, and the annulus of the wellbore while blocking fluid flow to the other ones.

Altering drilling fluid pressure again to position the pin in the groove at a third location which third location of the pin correlates with a third position of the housing; when the housing in in the third position, establishing fluid communication with the bore of the rotor and the annulus of the wellbore while blocking fluid flow to the stator of the power section.

The invention claimed is:

1. A control device for a downhole tool in a wellbore, the control device comprising:

a tubular housing having a first end and a second end and an internal flow pathway defined in the tubular housing, the internal flow pathway including a longitudinal bore and a flow channel radially spaced from the bore;

a sleeve disposed within the housing between the first end of the tubular housing and the internal flow pathway, the sleeve having a first end, a second end, an outer surface having a groove formed therein, wherein the sleeve is axially and rotatably moveable relative to the tubular housing;

a flow diverter assembly interconnected with the sleeve, the flow diverter assembly disposed within the tubular housing between the sleeve and the internal flow pathway, the flow diverter assembly movable between a first position, a second position and a third position, wherein the flow diverter assembly is in fluid communication with the flow channel of the internal flow pathway in the first position and in fluid communication with the longitudinal bore of the internal flow pathway in the second and third positions, wherein fluid flow to the flow channel of the internal flow pathway is blocked with the flow diverter assembly in the second and third positions and wherein fluid flow to the longitudinal bore of the internal flow pathway is greater with the flow diverter assembly in the third position than in the second position;

a follower having a pin extending into the groove of the sleeve, the follower fixed relative to the tubular housing, wherein the sleeve is axially and rotationally movable relative to the pin to position the pin at a first location in the groove when the flow diverter assembly is in the first position, to position the pin at a second location in the groove when the flow diverter assembly is in the second position and to position the pin at a third location in the groove when the diverter assembly is in the third position.

2. The control device of claim 1, further comprising a spring within the tubular housing, the spring disposed to urge the sleeve towards the first end of the tubular housing and away from the flow diverter assembly.

3. The control device of claim 2, further comprising a mandrel disposed within the tubular housing, where the sleeve is fixed to an outer surface of the mandrel and the spring is disposed about the mandrel.

4. The control device of claim 1, wherein the flow diverter assembly comprises a cylindrical housing having a first port and a primary bypass port, wherein the first port is in fluid communication with the internal flow pathway when the flow diverter assembly is in the first position and the primary bypass port is in fluid communication with the internal flow pathway when the flow diverter assembly is in the second position.

5. The control device of claim 4, wherein the flow diverter assembly comprises a secondary bypass port disposed therein, wherein the flow diverter assembly is in fluid communication with the longitudinal bore through the one of the primary bypass or secondary bypass ports when the flow diverter assembly is in the second position and the other of the primary bypass or secondary bypass ports when the flow diverter assembly is in the third position.

6. The control device of claim 1, wherein said groove is continuous about said sleeve and includes at least one step formed along the groove.

7. The control device of claim 1, wherein the longitudinal bore is in fluid communication with a formation testing and sampling tool and the flow channel is in fluid communication with a power section of a bottom hole assembly that operates in unison with the formation testing and sampling tool.

8. A system for drilling a wellbore, the system comprising:

a power section including a rotor and a stator and defining a space between the rotor and the stator, the rotor including a bore extending therethrough;

a formation testing and sampling tool;

a flow diverter assembly including a first port, a primary bypass port and a secondary bypass port, wherein the first port is fluidly coupled to the space between the rotor and the stator, and wherein the primary bypass port and the secondary bypass port are both fluidly coupled to the bore extending through the rotor; and an actuator assembly in communication with the flow diverter assembly wherein the actuator assembly is operable to move the flow diverter assembly between a first position wherein the primary and secondary bypass ports are blocked, a second position wherein the primary bypass port is open and the secondary bypass port is blocked and a third position wherein the primary and secondary bypass ports are open.

9. The system of claim 8, wherein the actuator assembly comprises an electronics module having a sonde, the electronics module interconnected with the flow diverter assembly to move the flow diverter assembly between the first position, the second position and the third position.

10. The system of claim 8, wherein the bore extending through the rotor is in fluid communication with the formation testing and sampling tool.

11. The system of claim 8, wherein the actuator assembly comprises:

a tubular housing having a first end and a second end and an internal flow pathway defined in the tubular housing, the internal flow pathway including a longitudinal bore and a flow channel radially spaced from the bore;

a sleeve disposed within the housing between the first end of the tubular housing and the internal flow pathway, the sleeve having a first end, a second end, an outer surface having a continuous indexing groove formed therein, wherein the sleeve is axially and rotatably moveable relative to the tubular housing; and a follower having a pin extending into the groove of the sleeve, the follower fixed relative to the tubular housing, wherein the sleeve is axially and rotationally movable relative to the pin to position the pin at a first location in the groove when the flow diverter assembly is in the first position and to position the pin at a second location in the groove when the flow diverter assembly is in the second position.

12. The system of claim 11, wherein the actuator assembly comprises a spring within the tubular housing, the spring disposed to urge the sleeve towards the first end of the tubular housing and away from the flow diverter assembly; and a mandrel disposed within the tubular housing, where the sleeve is fixed to an outer surface of the mandrel and the spring is disposed about the mandrel.

13. The system of claim 12, wherein the flow diverter assembly comprises a cylindrical housing having the primary bypass port and secondary bypass port.

14. The system of claim 11, wherein the flow diverter assembly is movable to the third position based on the positioning of the follower pin at a third location in the groove of the sleeve, wherein the flow diverter assembly is in fluid communication with both the longitudinal bore and the flow channel when the follower pin is at the third location.

15. The system of claim 8, wherein the actuator assembly is disposed above the formation testing and sampling tool.

16. A method for activating a downhole tool, the method comprising:

altering drilling fluid pressure in a wellbore;

using the change in the drilling fluid pressure to index a pin in a groove on an outer surface of a housing between at least a first location along the groove and a second location along the groove, a sleeve disposed above a power section in a bottom hole assembly, wherein the first location of the pin correlates to a first position of the housing and the second location of the pin correlates to a second position of the housing;

diverting drilling fluid flow to a wellbore annulus when the pin is at the first location along the groove and utilizing drilling fluid flow to drive the power section when the pin is at a second location along the groove;

altering the drilling fluid pressure again to index the pin in the groove between the second location and the first location;

when the housing is in the first position, establishing fluid communication with a stator of the power section;

when the housing is in the second position, establishing fluid communication with a bore of a rotor while blocking fluid flow to the wellbore annulus;

altering the drilling fluid pressure again to position the pin in the groove at a third location in which the third location of the pin correlates with a third position of the housing; and when the housing is in the third position, establishing fluid communication with the bore of the rotor and the wellbore annulus while blocking fluid flow to the stator of the power section.

17. The method of claim 16, further comprising:

simultaneously operating the power section and a formation testing and sampling tool in the bottom hole assembly.

* * * * *